US008128214B2

(12) United States Patent
Fujimori

(10) Patent No.: US 8,128,214 B2
(45) Date of Patent: Mar. 6, 2012

(54) LIQUID CHARGING APPARATUS AND LIQUID CHARGING METHOD

(75) Inventor: Chihiro Fujimori, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 896 days.

(21) Appl. No.: 12/144,498

(22) Filed: Jun. 23, 2008

(65) Prior Publication Data

US 2008/0316288 A1 Dec. 25, 2008

(30) Foreign Application Priority Data

Jun. 25, 2007 (JP) ..... 2007-166357

(51) Int. Cl.
*B41J 2/17* (2006.01)
*B41J 2/175* (2006.01)
*B41J 2/19* (2006.01)

(52) U.S. Cl. ..... 347/92; 347/84; 347/85

(58) Field of Classification Search ..... None
See application file for complete search history.

(56) References Cited

U.S. PATENT DOCUMENTS 5,950,403 A 9/1999 Yamaguchi et al.
7,841,706 B2 * 11/2010 Ishinaga et al. ..... 347/84
2007/0091129 A1 * 4/2007 Tsukahara et al. ..... 347/7

FOREIGN PATENT DOCUMENTS

EP 0857573 A2 8/1998
JP 2003-326730 11/2003
JP 2005-186343 7/2005
WO 2006131965 A1 12/2006

OTHER PUBLICATIONS

European Search Report for corresponding European application 08011448.1-1251.

* cited by examiner

*Primary Examiner* — Matthew Luu
*Assistant Examiner* — Renee I Wilson
(74) *Attorney, Agent, or Firm* — Kilpatrick Townsend & Stockton LLP

(57) ABSTRACT

An ink charging injection apparatus for charging ink to an ink pack is disclosed. The ink injection apparatus includes a pressurizing tank for storing ink, piping, a deaeration device, and an air vent pipe. The piping connects the pressurizing tank to the ink pack such that ink stored in the pressuring tank can be supplied from the pressurizing tank to the ink pack. The deaeration device is provided in the piping. The deaeration device is operated to produce suction for deaerating ink in the piping. The air vent pipe branches from a section of the piping and communicates with the deaeration device.

9 Claims, 2 Drawing Sheets

LIQUID CHARGING APPARATUS AND LIQUID CHARGING METHOD

CROSS-REFERENCE TO RELATED APPLICATION

This application is based upon and claims the benefit of priority from prior Japanese Patent Application No. 2007-166357, filed on Jun. 25, 2007, the entire content of which is incorporated herein by reference.

BACKGROUND

1. Technical Field

The present invention relates to a liquid charging apparatus and a liquid charging method for charging liquid such as ink into a liquid container such as an ink pack.

2. Related Art

An inkjet recording apparatus is known as a liquid ejection apparatus that ejects liquid such as ink onto a recording medium. Such an inkjet recording apparatus includes a recording head that ejects ink toward recording paper and an ink cartridge that stores ink to be supplied to the recording head.

To reduce the load applied to a carriage and reduce the size or the thickness of the inkjet recording apparatus, off-carriage type inkjet recording apparatuses have been introduced in which no ink cartridge is mounted on the carriage. Ink cartridges used in an off-carriage type inkjet recording apparatus have an ink pack storing ink, and the ink in the ink pack is supplied to a recording head through an ink supply tube.

Such an ink pack has a bag portion capable of storing ink and an outlet portion that, when the bag portion is pressurized with ink stored therein, discharges ink. The bag portion is formed of a film. Ink is charged into the bag portion by means of an ink charging apparatus. That is, the ink charging apparatus fills the bag with the ink stored in the ink tank, through the outlet portion. Thereafter, the outlet portion is sealed. At this time, it is preferable that the bag portion be filled with highly deaerated ink.

Japanese Laid-Open Patent Publication No. 2003-326730 discloses a liquid charging apparatus and a liquid charging method. In the technique disclosed in the publication, surplus ink is charged in a bag portion of an ink pack. Then, the bag portion is pressurized so that some of the ink, which is temporarily charged in the bag portion, is discharged through an outlet portion. Thereafter, a desired amount of ink is charged in the bag portion again, and the outlet portion is sealed. According to this technique, since some of the ink that has a high degree of dissolved air is discharged as surplus from the ink pack before the outlet portion is sealed to hermetically sealing the ink pack, the amount of air contained in the ink stored in the ink pack is reduced.

Japanese Laid-Open Patent Publication No. 2005-186343 discloses a configuration in which a deaeration unit is located in an ink pipe connecting an ink tank and an ink pack. The deaeration unit removes air dissolved in ink. Ink is supplied to the ink pack from the ink tank through the deaeration unit. Before the deaeration unit deaerates the ink supplied from the ink tank, the interior of the ink pipe is vacuumed to remove air from the ink pipe. Then, after removing the air from the ink pipe, ink is charged to the ink pack through the ink pipe.

According to the technique of Japanese Laid-Open Patent Publication No. 2003-326730, air can remain in the pipe connecting the ink tank to the ink pack. In such a case, when ink charging is performed using the same pipe after the pipe connects the ink tank and the ink pack, air in the pipe is mixed in the ink charged to the ink pack through the pipe, and the air is eventually dissolved in the ink. Thus, ink of a high degree of dissolved air is charged to the ink pack. After an excessive amount of such ink is charged, the charged ink needs to be discharged as waste ink. Accordingly, the efficiency of the liquid charging operation cannot be improved, and the apparatus construction is complicated.

According to the technique in Japanese Laid-Open Patent Publication No. 2005-186343, before charging ink from the ink tank to the ink pack while deaerating the ink, air is removed from the ink pipe. Thus, air in the ink pipe is not dissolved in the ink that is charged to the ink pack. However, other than the deaeration pump for removing air dissolved in ink, an air removing pump for removing air from the pipe needs to be provided in the pipe. This complicates the structure of the apparatus.

SUMMARY

Accordingly, it is an objective of the present invention to provide a liquid charging apparatus and a liquid charging method that quickly, readily, and reliably charge highly deaerated liquid to a liquid container.

In order to achieve the foregoing objective and in accordance with a first aspect of the present invention, a liquid charging apparatus for charging liquid to a liquid container is provided. The liquid charging apparatus includes a tank for storing the liquid, piping that connects the tank to the liquid container such that the liquid stored in the tank can be supplied from the tank to the liquid container, a deaeration device provided in the piping, and an air vent pipe is provided. The deaeration device produces suction that deaerates liquid in the piping. The air vent pipe branches from a section of the piping and communicates with the deaeration device.

In accordance with a second aspect of the present invention, a method for charging liquid stored in a tank to a liquid container through piping is provided. The method includes: providing, in the piping, a deaeration device that is operated to produce suction to deaerate liquid in the piping; operating the deaeration device in a state where an air vent pipe that branches from a section of the piping communicates with the deaeration device, thereby removing air from the piping; and supplying, after removing air from the piping, liquid from the tank to the liquid container through the piping while deaerating the liquid by means of the deaeration device, thereby charging the liquid to the liquid container.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DESCRIPTION OF EXEMPLARY EMBODIMENTS

One embodiment according to the present invention will now be described with reference to the drawings.

Figure 1:
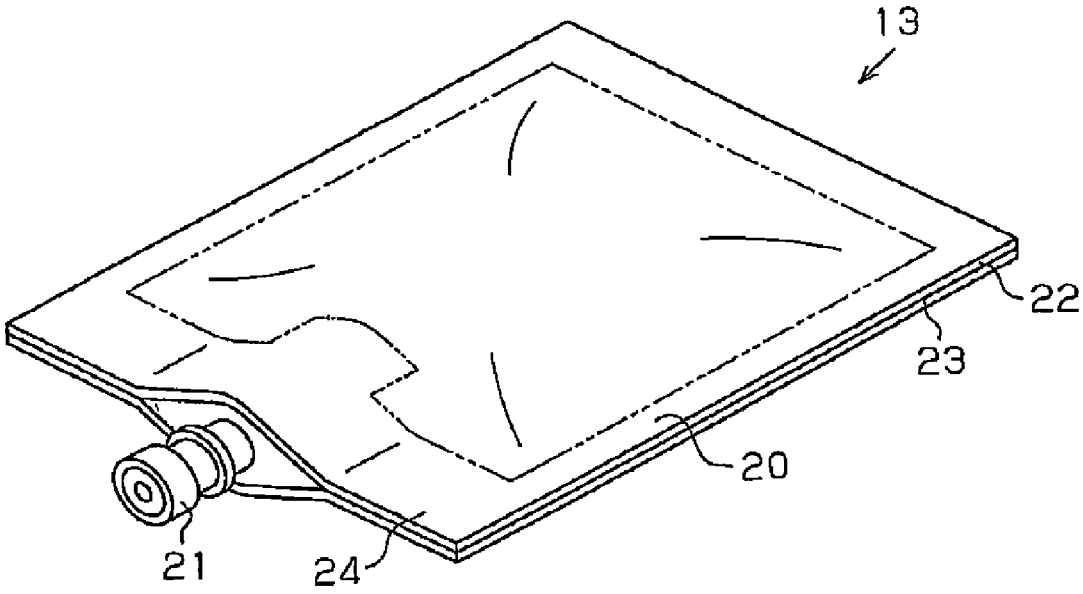
FIG. 1 is a diagrammatic perspective view showing an ink pack mounted on an inkjet recording apparatus according to one embodiment of the present invention.

As shown in FIG. 1, a liquid container, which is an ink pack 13, is mounted in an inkjet recording apparatus (hereinafter, referred to as printer), which is a liquid ejection apparatus. The ink pack 13 includes a bag portion 20 and an outlet portion 21. In the present embodiment, the bag portion 20 is formed by overlapping two rectangular film members 22, 23 of the same size and welding the four sides of the overlapped film members 22, 23. The outlet portion 21 is provided in one short side 24 (a side located on the left as viewed in FIG. 1) among the four sides of the bag portion 20. The outlet portion 21 is located between and welded to the film members 22, 23. Accordingly, a sealed interior space is formed in the bag portion 20. The space is filled with ink. The film members 22, 23 are, for example, made by depositing a gas barrier layer of, for example, aluminum on a thermoplastic resin layer of, for example, polyethylene film. The outlet portion 21 is made of a resin that can be welded to the thermoplastic resin layers of the film members 22, 23.

Next, an ink injection apparatus, which is a liquid charging apparatus for charging ink to the ink pack 13 (the bag portion 20), will now be described with reference to the drawings.

Figure 2:
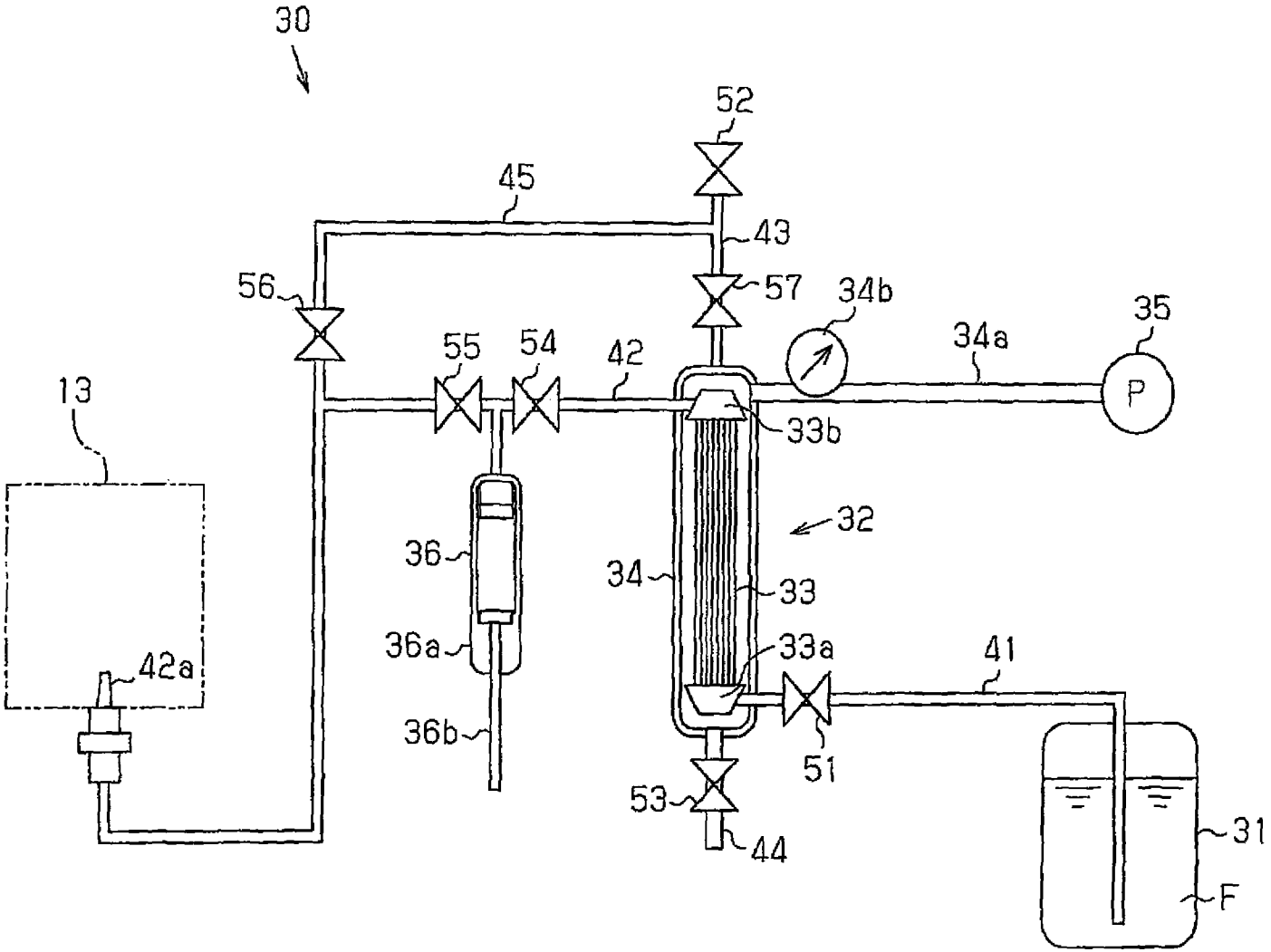
FIG. 2 is a diagram showing an ink injection apparatus used for charging ink to the ink pack shown in FIG. 1.

As shown in FIG. 2, an ink injection apparatus 30 has a tank, which is a pressurizing tank 31, a deaeration module 32, and piping that connects the pressurizing tank 31 to the ink pack 13 via the deaeration module 32. The pressurizing tank 31 stores liquid, which is ink F, under a pressurized state.

The piping includes a first pipe 41, which connects the pressurizing tank 31 to the deaeration module 32. The first pipe 41 has a first end portion inserted into the pressurizing tank 31. A first on-off valve, which is an on-off valve 51, is provided midway of the first pipe 41. The on-off valve 51 opens and closes the first pipe 41. That is, the on-off valve 51 is switched between a state (open state) in which fluid is permitted flow through the first pipe 41, and a state (closed state) in which fluid is inhibited from flowing. When the on-off valve 51 is in the open state, the ink F stored in the pressurizing tank 31 is pressure fed to the deaeration module 32 via the first pipe 41.

The deaeration module 32 has a hollow fiber bundle 33 and a housing 34 of a sealed structure The housing 34 accommodates the hollow fiber bundle 33. The hollow fiber bundle 33 is formed of a material that is not permeable to liquid, or the ink F, but permeable to gas, or air. The hollow fiber bundle 33 is formed of a number of thread-like tubes, and forms a line through the ink F flows. In the housing 34, a first end portion 33a of the hollow fiber bundle 33 (lower end in FIG. 2) is connected to a second end of the first pipe 41, and the ink F supplied from the pressurizing tank 31 to the deaeration module 32 is supplied to the hollow fiber bundle 33 through the first end portion. In the housing 34, a second end portion 33b (upper end in FIG. 2) of the hollow fiber bundle 33 is connected to a first end portion of a second pipe 42, and the ink F is conducted from the hollow fiber bundle 33 to the second pipe 42.

The housing 34 of the deaeration module 32 is connected to a suction device, which is a vacuum pump 35, through a discharge passage 34*a*, which communicates with the interior of the housing 34. As the vacuum pump 35 is operated, the interior of the housing 34 is depressurized. That is, when the vacuum pump 35 is operated, negative pressure is produced in the housing 34. The deaeration module 32 causes the ink F to flow through the hollow fiber bundle 33 while depressurizing the interior of the housing 34, thereby deaerating the ink F pressure fed from the pressurizing tank 31. In the present embodiment, the deaeration module 32 (the hollow fiber bundle 33 (line) and the housing 34) and the vacuum pump 35, which draws air from the housing 34 through the discharge passage 34*a* and discharges the air, form a deaeration device.

A suction pipe 43 and a discharge pipe 44 are connected to the housing 34 of the deaeration module 32. The pipes 43, 44 selectively connect the interior of the housing 34 to the atmosphere A suction valve 52 is proved in the suction pipe 43, and a third on-off valve, which is a discharge valve 53, is provided in the discharge pipe 44. In the suction pipe 43, a third on-off valve, which is a second air vent valve 57, is located between a section connected to the housing 34 and the suction valve 52. The discharge pipe 44 extends downward from a bottom wall located at the lowest part of the housing 34, so that ink F trapped in the housing 34 is permitted to flow to the outside of the housing 34. When the suction valve 52 and the second air vent valve 57 are open, the interior of the housing 34 is exposed to the atmospheric pressure.

A second end portion of the second pipe 42 is connected to an ink injection nozzle 42*a* . The ink injection nozzle 42*a* is inserted into the outlet portion 21 when charging the ink F in the ink pack 13. A first stop valve 54 and a second stop valve 55 are located in the second pipe 42. The second stop valve 55 is closer to the ink injection nozzle 42*a* than the first stop valve 54. A measuring tube 36 is connected a section between the first stop valve 54 and the second stop valve 55.

The measuring tube 36 includes a cylinder 36*a* and a piston 36*b*. When the piston 36*b* is pulled from the top dead center to the bottom dead center with the first stop valve 54 open and the second stop valve 55 closed, ink F that has passed through the hollow fiber bundle 33 is drawn into the cylinder 36*a* and stored there. On the other hand, when the piston 36*b* is pushed from the bottom dead center to the top dead center with the first stop valve 54 closed and the second stop valve 55 open, a certain amount of ink F stored in the cylinder 36*a* is pressure fed to the ink injection nozzle 42*a*. The amount of ink F stored in the cylinder 36*a* is less than or equal to the capacity of the bag portion 20 of the ink pack 13.

An end of an air vent pipe 45 is connected to a section of the second pipe 42 between the second stop valve 55 and the ink injection nozzle 42*a*. The other end of the air vent pipe 45 is connected to a section of the suction pipe 43 between the suction valve 52 and the second air vent valve 57. Thus, the air vent pipe 45 communicates with the interior of the housing 34 of the deaeration module 32 through a part of the suction pipe 43. That is, a part of the suction pipe 43 also functions as the air vent pipe 45. A second on-off valve, which is a first air vent valve 56, is located in the air vent pipe 45. The first air vent valve 56 selectively permits and blocks flow of fluid (ink F or air) through the air vent pipe 45. When the vacuum pump 35 is operated with both of the first air vent valve 56 and the second air vent valve 57 open, the interior of the housing 34 is depressurized, so that air in the first pipe 41, the hollow fiber bundle 33, and the second pipe 42 is drawn to the interior of the housing 34.

A method for injecting ink F into the ink pack 13 using the ink injection apparatus 30 will now be described. In the following, a case will be described in which a pressurizing tank 31 has been replaced by another pressurizing tank 31 filled with ink F that has not been deaerated, and the ink F is charged to a first ink pack 13 from the pressurizing tank 31. The interior of the piping of the ink injection apparatus 30 (the first pipe 41, the hollow fiber bundle 33, the second pipe 42, the air vent pipe 45, and the suction pipe 43) is not filled by the ink F, but is filled with air.

The ink charging method includes a liquid feeding step, an air venting step, and ink charging step.

In the liquid feeding step, first, the valves 51 through 53 and 57 are closed and the valves 54 through 56 are open in the ink injection apparatus 30 in FIG. 2. In this state, the vacuum pump 35 is operated to depressurize the interior of the housing 34 of the deaeration module 32 until the pressure reaches the degree of vacuum. Whether the interior of the housing 34 reaches vacuum is determined based on the measurement result of a pressure gauge 34*b* provided in the discharge passage 34*a*. When a predetermined time has elapsed since the interior of the housing 34 reaches vacuum, the on-off valve 51 is open.

Then, the ink F flows from the pressurizing tank 31 to the hollow fiber bundle 33 of the deaeration module 32 after passing through the on-off valve 51 of the first pipe 41. Thereafter, the ink F flows into the second pipe 42 after passing through the hollow fiber bundle 33. When the ink F reaches the inside of the second pipe 42, the on-off valve 51 is closed again. The ink F is deaerated when passing through the hollow fiber bundle 33, and the deaerated ink F flows into the second pipe 42. That is, when the ink F passes through the hollow fiber bundle 33, air contained in the ink F (hereinafter, referred to as dissolved air) leaves the surfaces of the hollow fiber bundle 33 and permeates the interior of the housing 34, which is in a depressurized state. The dissolved air is then discharged from the housing 34 to the outside through the discharge passage 34*a*.

As described above, in the liquid feeding step, the piping (the first pipe 41, the hollow fiber bundle 33, and the second pipe 42) is filled with the ink F at least up to a section a little past the deaeration module 32. Whether the ink F supplied from the pressurizing tank 31 has passed through the deaeration module 32 and reached the interior of the second pipe 42 may be visually checked by making a part of the second pipe 42 of a transparent material or by providing an additional sensor. When the piping is filled halfway with the ink F supplied from the pressurizing tank 31, the liquid feeding step is terminated, and the air venting step is started.

In the air venting step, the second air vent valve 57, which is closed when the liquid feeding step is terminated, is open. At this time, the vacuum pump 35 is being operated and the interior of the housing 34 remains depressurized to the vacuum level. In this state, air in the air vent pipe 45 and the second pipe 42, that is, air in the first pipe 41, the hollow fiber bundle 33, and the second pipe 42 (hereinafter, referred to as in-pipe air) is drawn to the interior of the housing 34. After drawn into the housing 34, the in-pipe air is discharged to the outside (the atmosphere) from the housing 34 through the discharge passage 34a.

After the in-pipe air is discharged to the outside, the second air vent valve 57 is closed and the on-off valve 51 is open. Then, the ink F supplied from the pressurizing tank 31 is deaerated in the deaeration module 32 and flows into the piping and fills the piping up to the section of the second air vent valve 57. As a result, the deaerated ink F fills the second pipe 42 up to the position of the ink injection nozzle 42*a*, and fills the air vent pipe 45, for example, up to the position of the first air vent valve 56. When the deaerated ink F fills the piping up to the position of the ink injection nozzle 42*a*, the first stop valve 54, the second stop valve 55, and the first air vent valve 56 are closed. Accordingly, the air venting step is terminated, and the ink charging step (liquid charging step) is started.

In the ink charging step, of the first stop valve 54 and the second stop valve 55, which are closed when the air venting step is terminated, the first stop valve 54 is first open. In this state, the piston 36*b* of the measuring tube 36 is pulled toward the bottom dead center, so that a predetermined amount of the ink F is introduced into the cylinder 36*a*. When a predetermined amount of the ink F is stored in the cylinder 36*a*, the first stop valve 54 is closed again.

Next, the ink injection nozzle 42*a* of the second pipe 42 is inserted into the outlet portion 21 of the ink pack 13 of which the bag portion 20 is not filled with ink F, and the ink pack 13 is attached to the ink injection apparatus 30 The second stop valve 55 is then open, and the piston 36*b* in the measuring tube 36 is pushed up toward the top dead center.

From the cylinder 36*a*, a predetermined amount of the ink F is pressure fed to the ink injection nozzle 42*a*, so that the ink F fills the ink pack 13. At this time, since air has been removed from the piping (the first pipe 41, the hollow fiber bundle 33, and the second pipe 42) through which the ink F flows, the degree of deaeration of the ink F, which is pressure fed to the nozzle 42*a*, is not lowered in the ink charging step. When the ink F fills the bag portion 20 of the ink pack 13, the second stop valve 55 is closed again. Accordingly, the ink charging process is terminated.

In the ink charging step, when the ink F passes through the hollow fiber bundle 33 of the deaeration module 32, the dissolved air in the ink F is drawn to the interior of the housing 34 in the depressurized state and discharged. For example, in the case where the hollow fiber bundle 33 has deteriorated due to age, some of the ink F leaks into the housing 34 together with dissolved air and is trapped there. Such ink F that is trapped in the housing 34 is preferably discharged to the outside. Therefore, to discharge the trapped ink F to the outside, a trapped ink treatment process after the ink charging apparatus.

Specifically, continuing the operation of the vacuum pump 35, the on-off valve 51 is closed, and the suction valve 52 and the air vent valve 57 are open. This exposes the interior of the housing 34 to the atmospheric pressure, and the ink F that has reached the position of the second air vent valve 57 of the suction pipe 43 and been trapped there in the air venting step and the ink charging step. Then, as the second air vent valve 57 is open, the ink F flows into the housing 34 and is mixed with the ink F that has already been trapped in the housing 34. From this state, the vacuum pump 35 is stopped, and the discharge valve 53 is open. Since the interior of the housing 34 is exposed to the atmospheric pressure, the ink F trapped in the housing 34 is discharged to the outside through the discharge pipe 44.

The preferred embodiment provides the following advantages.

(1) According to the present embodiment, the air vent pipe 45 is connected to a section of the second pipe 42 between the second stop valve 55 and the ink injection nozzle 42*a*. Before charging the ink F to the ink pack 13, air existing in the first pipe 41, the hollow fiber bundle 33, and the second pipe 42 (the in-pipe air) is discharged through the air vent pipe 45.

Further, the air vent pipe 45 is connected to and communicates with the housing 34 of the deaeration module 32. Therefore, in the air venting step, the in-pipe air originally existed in the firs-L pipe 41, the hollow fiber bundle 33, and the second pipe 42 is reliably removed while removing the dissolved air in the ink F by the vacuum pump 35 connected to the existing deaeration module 32. In this manner, since the vacuum pump 35 is used as a pump for deaeration and air vent, ink is quickly, easily, and reliably charged to the ink pack 13 with a simple structure.

As a result, the in-pipe air, which has originally existed in the first pipe 41, the hollow fiber bundle 33, and the second pipe 42 is not charged to the ink pack 13 with the ink F in the ink charging step.

Further, air vent is completed in one cycle of the air venting step. Thus, unlike the conventional configuration, there is no need to perform a number of cycles of a step in which ink is supplied to an ink pack, and then the ink is discharged to refill the ink pack with ink. This improves the efficiency of the use of the ink F, and greatly facilitates the treatment of waste ink.

(2) In the ink charging step of the present embodiment, the ink pack 13 is filled with the ink F without discharging the ink F from the first pipe 41, the hollow fiber bundle 33, and the second pipe 42. Thus, the ink F is used efficiently.

(3) In the present embodiment, the ink F in the pressurizing tank 31 is pressurized. Thus, if the piping between the on-off valve 51 and the ink pack 13 (the ink injection nozzle 42*a*), that is, the first pipe 41 and the second pipe 42 are in the depressurized state, opening the on-off valve 51 allows the ink F in the pressurizing tank 31 to be pressure fed to the ink injection nozzle 42*a*. Therefore, no mechanism for sending the ink F in the pressurizing tank 31 to the ink injection nozzle 42*a* is required.

The present embodiment is not limited to the configuration shown above, but may be modified as shown below.

The liquid feeding step may be changed as long as at least a section of the piping between the pressurizing tank 31 and a position past the deaeration module 32 is filled with the ink F. Therefore, the liquid feeding step may be changed such that a section of the first pipe 41 up to the ink injection nozzle 42*a* and a section of the air vent pipe 45 up to the first air vent valve 56 are filled with the ink F.

As a tank for storing liquid, a tank other than the pressurizing tank 31, which stores the ink F in a pressurized state, may be used. In such a case, a squeeze pump is preferably provided to send ink F to the injection nozzle 42*a*.

In the illustrated embodiment, the valves provided in the ink injection apparatus 30, that is, the on-off valve 51, the suction valve 52, the discharge valve 53, the first stop valve 54, the second stop valve 55, the first air vent valve 56, and the second air vent valve 57 may be configured to automatically open and close.

In the illustrated embodiment, one end of the air vent pipe 45 does not need to be connected to a section in the suction pipe 43, but may be directly connected to the housing 34 of the deaeration module 32.

In the illustrated embodiment, the present invention is applied to a case where the liquid container is the ink pack 13 attached to a printer that ejects ink F. However, the present invention may be applied to a liquid container used in other apparatuses. For example, the present invention may be applied to a liquid container used in printing machines including fax machines and copy machines, a liquid ejecting apparatus for ejecting liquid such as electrode material or color material used for manufacturing liquid crystal displays, electro luminescent displays and surface emitting displays. The present invention may also be applied to a liquid container used in liquid ejecting apparatus for ejecting biological organic matter used for manufacturing biochips. Alternatively, the present invention may be applied to a liquid container used in sample ejecting apparatus such as a precision pipette. Also, the present invention may be applied to devices that use liquid other than ink. Further, the present invention may be applied to a liquid container used in apparatuses other than liquid ejection apparatuses.

What is claimed is:

1. A liquid charging apparatus for charging liquid to a liquid container, comprising:

a tank for storing the liquid a piping system that connects the tank to the liquid container such that the liquid stored in the tank can be supplied from the tank to the liquid container, wherein an ink injection nozzle is inserted into the liquid container;

a deaeration device provided in the piping system, the deaeration device producing suction that deaerates liquid in the piping system; and an air vent pipe that branches from a section of the piping system and communicates with the deaeration device, wherein the air vent pipe is located between the ink injection nozzle and the deaereation device.

2. The apparatus according to claim 1, further comprising a first on-off valve located in a section of the piping system between the deaeration device and the tank, the first on-off valve being capable of opening and closing the piping system, wherein the air vent pipe is branched from a section of the piping system between the first on-off valve and the liquid container.

3. The apparatus according to claim 1, further comprising a second on-off valve located in the air vent pipe, the second on-off valve being capable of opening and closing the air vent pipe.

4. The apparatus according claim 1, wherein the deaeration device has a line forming a part of the piping system, a hermetic piping system accommodating the line, and a suction device that applies suction to the interior of the housing, wherein the line is made of a material that is permeable to air and impermeable to liquid, and wherein the air vent pipe is connected to the housing to communicate with the interior of the housing.

5. A liquid charging apparatus for charging liquid to a liquid container, comprising:

a tank for storing the liquid;

a piping system that connects the tank to the liquid container such that the liquid stored in the tank can be supplied from the tank to the liquid container;

a deaeration device provided in the piping system, the deaeration device producing suction that deaerates liquid in the piping system; and an air vent pipe that branches from a section of the piping system and communicates with the deaeration device, wherein the deaeration device has a line forming a part of the piping system, a hermetic piping system accommodating the line, and a suction device that applies suction to the interior of the housing, wherein the line is made of a material that is permeable to air and impermeable to liquid, wherein the air vent pipe is connected to the housing to communicate with the interior of the housing, wherein the housing has a suction pipe that allows atmospheric air to flow into the housing, and a discharge pipe that allows liquid flows out from the housing, and wherein each of the suction pipe and the discharge pipe is provided with a third on-off valve capable of opening and closing the pipe.

6. A method for charging liquid stored in a tank to a liquid container through a piping system, wherein an ink injection nozzle is inserted into the liquid container, the method comprising:

providing, in the piping system, a deaeration device that is operated to produce suction to deaerate liquid in the piping system;

operating the deaeration device in a state where an air vent pipe that branches from a section of the piping system communicates with the deaeration device, thereby removing air from the piping system wherein the air vent pipe is located between the ink injection nozzle and the deaeration device; and supplying, after removing air from the piping system, liquid from the tank to the liquid container through the piping system while deaerating the liquid by means of the deaeration device, thereby charging the liquid to the liquid container.

7. The method according to claim 6, wherein, after a section of the piping system between the deaeration device and the tank is closed to inhibit fluid from flowing therethrough, the deaeration device is operated to remove air from the piping system.

8. The method according to claim 6, wherein, after the air vent pipe is closed to inhibit fluid from flowing therethrough, the liquid container is filled with liquid.

9. The method according to claim 6, wherein, before removing air from the piping system, liquid is supplied from the tank to the piping system such that the liquid fills at least a section of the piping system between the tank and a position past the deaeration device.

* * * * *